US007270742B2

(12) United States Patent
Karas et al.

(10) Patent No.: US 7,270,742 B2
(45) **Date of Patent: *Sep. 18, 2007**

(54) ORGANOSULFUR OXIDATION PROCESS

(75) Inventors: Lawrence J. Karas, West Chester, PA (US); Yuan-Zhang Han, West Chester, PA (US); David W. Leyshon, West Chester, PA (US)

(73) Assignee: Lyondell Chemical Technology, L.P., Greenville, DE (US)

( * ) Notice: Subject to any disclaimer, the term of this patent is extended or adjusted under 35 U.S.C. 154(b) by 505 days.

This patent is subject to a terminal disclaimer.

(21) Appl. No.: 10/387,908

(22) Filed: Mar. 13, 2003

(65) Prior Publication Data

US 2004/0178122 A1 Sep. 16, 2004

(51) Int. Cl.
*C10G 17/00* (2006.01)

(52) U.S. Cl. ..... 208/254 R; 196/200; 196/204

(58) Field of Classification Search ..... 208/254 R, 208/196, 200, 204
See application file for complete search history.

(56) References Cited

U.S. PATENT DOCUMENTS

| | | | | |
|---|---|---|---|---|
| 3,816,301 A | | 6/1974 | Sorgenti | 208/208 R |
| 4,367,342 A | | 1/1983 | Wulff et al. | 549/529 |
| 4,483,763 A | * | 11/1984 | Kuk et al. | 208/254 H |
| 5,759,945 A | | 6/1998 | Carroll et al. | 502/242 |
| 5,985,136 A | | 11/1999 | Brignac et al. | 208/216 R |
| 6,011,162 A | | 1/2000 | Han et al. | 549/529 |
| 6,114,552 A | | 9/2000 | Han et al. | 549/529 |
| 6,187,934 B1 | | 2/2001 | Tsuji et al. | 549/529 |
| 6,323,147 B1 | | 11/2001 | Yamamoto et al. | 502/64 |
| 6,368,495 B1 | * | 4/2002 | Kocal et al. | 208/240 |
| 6,402,939 B1 | | 6/2002 | Yen et al. | 208/196 |
| 6,500,969 B1 | * | 12/2002 | Zhou et al. | 549/531 |
| 6,551,501 B1 | * | 4/2003 | Whitehurst et al. | 208/211 |

FOREIGN PATENT DOCUMENTS

| | | |
|---|---|---|
| EP | 0 345 856 | 12/1989 |
| EP | 0 492 697 | 7/1992 |

OTHER PUBLICATIONS

Castillo et al., *J. Catalysis* 161, pp. 524-529 (1996).

* cited by examiner

*Primary Examiner*—Tam M. Nguyen
(74) *Attorney, Agent, or Firm*—Kevin M. Carroll

(57) ABSTRACT

This invention is a method of purifying fuel streams containing organonitrogen and organosulfur impurities. The fuel stream is first treated to extract organonitrogen impurities so that the nitrogen content of the fuel stream is reduced by at least 50 percent. After separation and recovery of the nitrogen-depleted fuel stream, the organosulfur impurities in the fuel stream are then oxidized with an organic hydroperoxide in the presence of a titanium-containing silicon oxide catalyst. The resulting sulfones may be more readily removed from the fuel stream than the non-oxidized organosulfur impurities.

21 Claims, No Drawings

ORGANOSULFUR OXIDATION PROCESS

FIELD OF THE INVENTION

This invention relates to a process for oxidizing organosulfur impurites found in fuel streams. The process comprises first removing nitrogen compounds in the fuel streams followed by oxidizing the organosulfur impurites by reaction with an organic hydroperoxide in the presence of a titanium-containing silicon oxide catalyst. The nitrogen removal step is found to improve the life of the titanium-containing silicon oxide catalyst.

BACKGROUND OF THE INVENTION

Hydrocarbon fractions produced in the petroleum industry are typically contaminated with various sulfur impurities. These hydrocarbon fractions include diesel fuel and gasoline, including natural, straight run and cracked gasolines. Other sulfur-containing hydrocarbon fractions include the normally gaseous petroleum fraction as well as naphtha, kerosene, jet fuel, fuel oil, and the like. The presence of sulfur compounds is undesirable since they result in a serious pollution problem. Combustion of hydrocarbons containing these impurities results in the release of sulfur oxides which are noxious and corrosive.

Federal legislation, specifically the Clean Air Act of 1964 as well as the amendments of 1990 and 1999 have imposed increasingly more stringent requirements to reduce the amount of sulfur released to the atmosphere. The United States Environmental Protection Agency has lowered the sulfur standard for diesel fuel to 15 parts per million by weight (ppmw), effective in mid-2006, from the present standard of 500 ppmw. For reformulated gasoline, the current standard of 300 ppmw has been lowered to 30 ppmw, effective Jan. 1, 2004.

Because of these regulatory actions, the need for more effective desulfurization methods is always present. Processes for the desulfurization of hydrocarbon fractions containing organosulfur impurities are well known in the art. The most common method of desulfurization of fuels is hydrodesulfurization, in which the fuel is reacted with hydrogen gas at elevated temperature and high pressure in the presence of a costly catalyst. U.S. Pat. No. 5,985,136, for example, describes a hydrodesulfurization process to reduce sulfur level in naptha feedstreams. Organic sulfur is reduced by this reaction to gaseous $H_2S$, which is then oxidized to elemental sulfur by the Claus process. Unfortunately, unreacted $H_2S$ from the process is harmful, even in very small amounts. Although hydrodesulfurization readily converts mercaptans, thioethers, and disulfides, other organsulfur compounds such as substituted and unsubstituted thiophene, benzothiophene, and dibenzothiophene are difficult to remove and require harsher reaction conditions.

Because of the problems associated with hydrodesulfurization, research continues on other sulfur removal processes. For instance, U.S. Pat. No. 6,402,939 describes the ultrasonic oxidation of sulfur impurities in fossil fuels using hydroperoxides, especially hydrogen peroxide. These oxidized sulfur impurities may be more readily separated from the fossil fuels than non-oxidized impurities. Another method involves the desulfurization of hydrocarbon materials where the fraction is first treated by oxidizing the sulfur-containing hydrocarbon with an oxidant in the presence of a catalyst. U.S. Pat. No. 3,816,301, for example, discloses a process for reducing the sulfur content of sulfur containing hydrocarbons by oxidizing at least of portion of the sulfur impurities with an organic hydroperoxide such as t-butyl hydroperoxide in the presence of certain catalysts. The catalyst described is preferably a molybdenum-containing catalyst.

We have found that although titanium-containing catalysts are effective at oxidizing sulfur impurities in hydrocarbon fractions, the catalyst is prone to deactivation due to the presence of nitrogen-containing impurities in the hydrocarbon fraction.

In sum, new methods to oxidize the sulfur compound impurities in hydrocarbon fractions are required. Particularly required are processes which effectively oxidize the difficult to oxidize thiophene impurities. We have discovered that the process for oxidizing organosulfur impurites found in fuel streams is improved by first removing organonitrogen impurities from the fuel stream.

SUMMARY OF THE INVENTION

This invention is a process for oxidizing organosulfur impurites found in fuel streams. The process comprises a preliminary step of extracting organonitrogen impurities from the fuel stream prior to oxidation, such that the nitrogen content of fuel stream is reduced by at least 50 percent. The organonitrogen extraction step can be performed by suitable extraction methods such as solid-liquid extraction using adsorbents and liquid-liquid extraction using polar solvents. The fuel stream having a reduced amount of organonitrogen impurities is separated and recovered, then contacted with an organic hydroperoxide in the presence of a titanium-containing silicon oxide catalyst to convert a substantial portion of the organosulfur impurities to sulfones. The sulfones may then be extracted from the fuel stream to form a purified fuel stream. We found that the nitrogen removal step prior to oxidation results in increased catalyst life of the titanium-containing catalyst in the oxidation process.

DETAILED DESCRIPTION OF THE INVENTION

The process of the invention comprises oxidizing organosulfur impurities found in fuel streams with an organic hydroperoxide in the presence of a titanium-containing silicon oxide catalyst. Over time, the titanium-containing silicon oxide catalyst tends to slowly deteriorate in performance when used repeatedly or in a continuous process. The deterioration appears to be associated with the presence of organonitrogen impurities in the fuel stream itself. Removal of the organonitrogen impurities is therefore an important aspect of the invention of the process. Prior to oxidation of the organosulfur impurities, the fuel stream is subjected to an organonitrogen removal step.

This invention includes the removal of organonitrogen impurities from fuel streams by extraction. Purification by extraction methods is well-known in the art. Suitable extraction methods include, but are not limited to, solid-liquid extractions using adsorbents and liquid-liquid extractions using polar solvents. In a typical solid-liquid extraction, the fuel stream is contacted in the liquid phase with at least one solid adsorbent. The adsorbents useful in the invention include any adsorbent capable of removing organonitrogen impurities from fuel streams. Useful adsorbents include aluminum oxides, silicon oxides, silica-aluminas, Y zeolites, Zeolite X, ZSM-5, and sulfonic acid resins such as Amberlyst 15 (available from Rohm and Haas). Particularly useful adsorbents include aluminum oxides, silica-aluminas, and Y zeolites The adsorptive contact is conveniently carried out at temperatures in the range of about 15° C. to 90° C., preferably 20° C. to 40° C. The flow rates are not critical, however flow rates of about 0.5 to 10 volumes of the fuel stream per volume of adsorbent per hour are preferred, with a flow rate of about 1 to 5 volumes particularly preferred. It is generally preferred to employ more than one adsorbent contact beds so that a depleted bed can be regenerated while a fresh bed is used. Regeneration can be by washing with water, methanol, or other solvents, followed by drying or by stripping with a heated inert gas such as steam, nitrogen or the like.

In a typical liquid-liquid extraction process, an impure stream is contacted with an extraction liquid. The extraction liquid is immiscible with and has a different (usually lower) density than the impure stream. The mixture is intimately mixed by any of a variety of different techniques. During the intimate mixing, the impurity passes from the impure stream into the extraction liquid, to an extent determined by the so-called partition coefficient of such substance in the conditions concerned. Extraction processes may be operated batch-wise or continuously. The impure stream may be mixed with an immiscible extraction liquid in an agitated vessel, after which the layers are settled and separated. The extraction may be repeated if more than one contact is required. Most extraction equipment is continuous, with either successive stage contacts or differential contacts. Typical liquid extraction equipment includes mixer-settlers, vertical towers of various kinds which operate by gravity flow, agitated tower extractors, and centrifugal extractors.

The liquid-liquid extraction embodiment of the invention comprises contacting the fuel stream containing organonitrogen and organosulfur impurities with a polar solvent. Any polar solvent that is immiscible and having a different density than the fuel stream may be used. Particular preferred polar solvents are selected from the group consisting of alcohol, ketone, water, and mixtures thereof. The alcohol may be any alcohol that is immiscible with the fuel stream, and is preferably a $C_1$-$C_4$ alcohol, most preferably methanol. The ketone may be any ketone that is immiscible with the fuel stream, and is preferably a $C_3$-$C_8$ aliphatic ketone, such as acetone and methyl ethyl ketone, or mixtures of ketones containing acetone. Especially preferred solvents include mixtures of alcohol and water, most preferably a methanol-water mixture. When alcohol-water mixtures are used as the extraction solvent, the mixture preferably comprises about 0.5 to about 50 weight percent water, most preferably from about 1 to about 10 weight percent water. The solvent:fuel stream ratio is not critical but preferably is from about 10:1 to about 1:10.

Other extraction media, both solid and liquid, will be readily apparent to those skilled in the art of extracting polar species. In the process of the invention, the extraction step removes at least 50 percent of the nitrogen content from the fuel stream. Preferably, more than about 70 percent of the nitrogen content in the fuel stream is removed during extraction. After extraction, the fuel stream is then separated and recovered using known techniques.

Following the extraction of organonitrogen impurities, and separating and recovering the fuel stream having a reduced amount of organonitrogen impurities, the fuel stream is then passed through to the oxidation process.

The oxidation process of the invention utilizes a titanium-containing silicon oxide catalyst. Titanium-containing silicon oxide catalysts are well known and are described, for example, in U.S. Pat. Nos. 4,367,342, 5,759,945, 6,011,162, 6114,552, 6,187,934, 6,323,147, European Patent Publication Nos. 0345856 and 0492697 and Castillo et al., *J. Catalysis* 161, pp. 524-529 (1996), the teachings of which are incorporated herein by reference in their entirety.

Such titanium-containing silicon oxide catalysts typically comprise an inorganic oxygen compound of silicon in chemical combination with an inorganic oxygen compound of titanium (e.g., an oxide or hydroxide of titanium). The inorganic oxygen compound of titanium is preferably combined with the oxygen compound of silicon in a high positive oxidation state, e.g., tetravalent titanium. The proportion of the inorganic oxygen compound of titanium contained in the catalyst composition can be varied, but generally the catalyst composition contains, based on total catalyst composition, at least 0.1% by weight of titanium with amounts from about 0.2% by weight to about 50% by weight being preferred and amounts from about 0.2% to about 10% by weight being most preferred.

One class of titanium-containing silicon oxide catalysts particularly suitable for the oxidation of organosulfur impurities is titania-on-silica (also sometimes referred to as "$TiO_2/SiO_2$"), which comprises titanium (titanium dioxide) supported on silica (silicon dioxide). The titania-on-silica may be in either silylated or nonsilylated form.

The preparation of titania-on-silica catalysts may be accomplished by a variety of techniques known in the art. One such method involves impregnating an inorganic siliceous solid support with a titanium tetrahalide (e.g., $TiCl_4$), either by solution or vapor-phase impregnation, followed by drying and then calcination at an elevated temperature (e.g., 500° C. to 900° C.). Vapor-phase impregnation is described in detail in European Patent Pub. No. 0345856 (incorporated herein by reference in its entirety). U.S. Pat. No. 6,011,162 discloses a liquid-phase impregnation of silica using titanium halide in a non-oxygen containing solvent. In another technique, the catalyst composition is suitably prepared by calcining a mixture of inorganic siliceous solids and titanium dioxide at elevated temperature, e.g., 500° C. to 1000° C. Alternatively, the catalyst composition is prepared by cogelling a mixture of a titanium salt and a silica sol by conventional methods of preparing metal supported catalyst compositions.

The titanium-containing silicon oxide catalysts may optionally incorporate non-interfering and/or catalyst promoting substances, especially those which are chemically inert to the oxidation reactants and products. The catalysts may contain minor amounts of promoters, for example, alkali metals (e.g., sodium, potassium) or alkaline earth metals (e.g., barium, calcium, magnesium) as oxides or hydroxides. Alkali metal and/or alkaline earth metal levels of from 0.01 to 5% by weight based on the total weight of the catalyst composition are typically suitable.

The catalyst compositions may be employed in any convenient physical form such as, for example, powder, flakes, granules, spheres or pellets. The inorganic siliceous solid may be in such form prior to impregnation and calcination or, alternatively, be converted after impregnation and/or calcination from one form to a different physical form by conventional techniques such as extrusion, pelletization, grinding or the like.

The organosulfur oxidation process of the invention comprises contacting the fuel stream having a reduced amount of organonitrogen impurities with an organic hydroperoxide in the presence of the titanium-containing silicon oxide catalyst. Suitable fuel streams include diesel fuel and gasoline, including natural, straight run and cracked gasolines. Other sulfur-containing fuel streams include the normally gaseous petroleum fraction as well as naphtha, kerosine, jet fuel, fuel oil, and the like. Diesel fuel is a particularly preferred fuel stream.

Preferred organic hydroperoxides are hydrocarbon hydroperoxides having from 3 to 20 carbon atoms. Particularly preferred are secondary and tertiary hydroperoxides of from 3 to 15 carbon atoms. Exemplary organic hydroperoxides suitable for use include t-butyl hydroperoxide, t-amyl hydroperoxide, cyclohexyl hydroperoxide, ethylbenzene hydroperoxide, and cumene hydroperoxide. T-butyl hydroperoxide is especially useful.

In such an oxidation process the sulfur compound:hydroperoxide molar ratio is not particularly critical, but it is preferable to employ a molar ratio of approximately 2:1 to about 1:2.

The oxidation reaction is conducted in the liquid phase at moderate temperatures and pressures. Suitable reaction temperatures vary from 0° C. to 200° C., but preferably from 25° C. to 150° C. The reaction is preferably conducted at or above atmospheric pressure. The precise pressure is not critical. The titanium-containing silicon oxide catalyst composition, of course, is heterogeneous in character and thus is present as a solid phase during the oxidation process of this invention. Typical pressures vary from 1 atmosphere to 100 atmospheres.

The oxidation reaction may be performed using any of the conventional reactor configurations known in the art for such oxidation processes. Continuous as well as batch procedures may be used. For example, the catalyst may be deployed in the form of a fixed bed or slurry.

The oxidation process of the invention converts a substantial portion of the organosulfur impurities into sulfones. Typically, greater than about 50 percent of the organosulfur impurities are converted into sulfones, preferably greater than about 80 percent, and most preferably greater than about 90 percent. When the oxidation has proceeded to the desired extent, the product mixture may be treated to remove the sulfones from the fuel stream. Typical sulfone removal processes include solid-liquid extraction using absorbents such as silica, alumina, polymeric resins, and zeolites. Alternatively, the sulfones can be removed by liquid-liquid extraction using polar solvents such as methanol, acetone, dimethyl formamide, N-methylpyrrolidone, or acetonitrile. Other extraction media, both solid and liquid, will be readily apparent to those skilled in the art of extracting polar species.

The following examples merely illustrate the invention. Those skilled in the art will recognize many variations that are within the spirit of the invention and scope of the claims.

EXAMPLE 1

Liquid-Liquid Extraction of Diesel Fuel With a Methanol-Water Mixture

EXAMPLE 1A

Lyondell Citgo Refinery Diesel containing 130 ppm nitrogen is contacted at 25° C. with a methanol-water mixture (2.5 weight % water in methanol). The weight ratio of diesel:methanol-water is 1:1. The resulting diesel phase is analyzed to contain 49 ppm N. The resulting methanol-water phase is analyzed to contain 81 ppm N.

EXAMPLE 1B

Chevron Diesel containing 30 ppm nitrogen is contacted at 25° C. with a methanol-water mixture (2.5 weight % water in methanol). The weight ratio of diesel:methanol-water is 1:1. The resulting diesel phase is analyzed to contain 13 ppm N. The resulting methanol-water phase is analyzed to contain 28 ppm N.

EXAMPLE 2

Solid-Liquid Extraction of Diesel Fuel with a Adsorbents

Chevron diesel contains 380 ppm S and 32 ppm N is contacted with several adsorbents. The test is carried out by mixing fuel (25 g) and adsorbent powder (1 g) and stirring the mixture for 24 hours. The results are shown in Table 1. Amberlyst resins (A-15, A-35, A-36), Zeolite X, Na form (UOP X-13), Zeolite Y (Si/Al=60, Zeolyst CBV 760), ZSM-5(H) (Si/Al=80, Zeolyst CBV8014), silica (Grace Silica V-432), silica alumina (Grace Davicat SIAL 3113, 13% alumina), and alumina (Selexorb COS, Selexorb CDX, Selexorb CDO-200, and Dynocel 600) are tested. Alumina, silica alumina, and acidic Y zeolites give the best performance under these test conditions. Although sulfonic acid resins, Zeolite X, ZSM-5, and silica result in less removal of organonitrogen species, the results may be improved by increasing adsorbent amount or contact time.

EXAMPLE 3

Oxidation of Sulfur Impurities in Diesel Fuel Using Nitrogen Extracted Fuel

Chevron/Phillips diesel containing 30 ppm N and 380 ppm S is tested in a continuous oxidation run using a titania-on-silica catalyst synthesized as described below. First, untreated diesel is pretreated by passing the diesel over an alumina bed to remove organonitrogen impurities so that the nitrogen content of fuel is less than 7 ppm N.

A reaction mixture of 99% diesel fuel (plus toluene) and 1% Lyondell TBHP oxidate (containing approximately 43 wt. % TBHP and 56 wt. % tertiary butyl alcohol) is fed to a fixed-bed reactor containing titania-on-silica catalyst (50 cc, 21 g) at a liquid hourly space velocity of 3 $hr^{-1}$, a temperature of 80° C. The diesel is fed to the reactor at 150 cc/hr. A 1:1 mixture of toluene:TBHP oxidate is fed to the reactor at 3 cc/hr. During the first 2 weeks of operation, the pretreated (nitrogen-depleted) diesel is used. The sulfur content after oxidation and removal of sulfones by alumina adsorption for the first 2 weeks of operation is less than 12 ppm S. After a two-week run with the pretreated diesel, the feed is switched to untreated diesel and sulfur content rapidly increased to 50 ppm. After a one-week run using the untreated diesel, the feed is switched back to the pretreated (nitrogen-depleted) diesel. The sulfur content after oxidation and removal of sulfones by alumina adsorption for the second run with pretreated diesel is approximately 20 ppm S. The results indicate some irreversible deactivation of the titania-on-silica catalyst using the untreated diesel compared to pretreated diesel.

EXAMPLE 4

Preparation of Titania-On-Silica Catalyst

Silica (Grace Davison DAVICAT P-732) is dried at 400° C. in air for 4 hours. The dried silica (39.62 g) is charged into a 500-mL 3-neck round-bottom flask equipped with an inert gas inlet, a gas outlet, and a scrubber containing aqueous sodium hydroxide solution. Into the flask described above, a solution consisting of n-heptane (84.21 g, 99+%, water <50 ppm) and titanium (IV) tetrachloride (5.02 g) is added under dry inert gas atmosphere. The mixture is mixed well by swirling. The solvent is removed by heating with an oil bath at 125° C. under nitrogen flow for 1.5 hours.

A portion of above material (35 g) is calcined by charging it into a tubular quartz reactor (1 inch ID, 16 inch long) equipped with a thermowell, a 500 mL 3-neck round-bottom flask, a heating mantle, an inert gas inlet, and a scrubber (containing sodium hydroxide solution). The catalyst bed is heated to 850° C. under dry nitrogen (99.999%) flow (400 cc/min). After the bed is maintained at 850° C. for 30 min, the power to the furnace is turned off and the catalyst bed is cooled to 400° C.

The catalyst is then hydrated by the following procedure. Water (3.0 g) is added into the 3-neck round-bottom flask and the flask is heated with a heating mantle to reflux while maintaining the nitrogen flow at 400 cc/min. The water is distilled through the catalyst bed over a period of 30 minutes. A heat gun is used to heat the round-bottom flask to ensure that any residual water is driven out of the flask through the bed. The bed is then maintained at 400° C. for an additional 2 hours before cooling.

The catalyst is then silylated as follows. A 500 mL 3-neck round-bottom flask is equipped with a condenser, a thermometer, and an inert gas inlet. The flask is charged with heptane (39 g, water <50 ppm), hexamethyldisilazane (3.10 g) and Catalyst 1C (11.8 g). The system is heated with oil bath to reflux (98° C.) for 2 hours under inert atmosphere before cooling. The catalyst is filtered and washed with heptane (100 mL). The material is then dried in a flask under inert gas flow at 180-200° C. for 2 hours. The titania-on-silica catalyst contains 3.5 wt. % Ti and 1.97 wt. % C.

TABLE 1

Adsorption of N and S from Diesel Fuel

| Run | Adsorbent | Surface Area ($m^2/g$) | N (ppm) | S (ppm) |
|---|---|---|---|---|
| 2A | A-15 | 50 | 19 | 371 |
| 2B | A-35 | | 20 | 366 |
| 2C | A-36 | | 21 | 374 |
| 2D | X-zeolite, UOP X-13 | | 21 | 362 |
| 2E | ZSM-5, Zeolyst CBV8014 | 425 | 20 | 353 |
| 2F | Silica | 300 | 23 | 366 |
| 2G | Y-zeolite, Zeolyst CBV 760 | 720 | 8 | 341 |
| 2H | Silica-alumina, Grace Davicat SIAL 3113 | 500 | 7 | 348 |
| 2I | Alumina, Selexorb COS | 280 | 13 | 359 |
| 2J | Alumina, Selexorb CDX | 460 | 6 | 351 |
| 2K | Alumina, Selexorb CDO-200 | 200 | 11 | 357 |
| 2L | Alumina, Dynocel 600 | 350 | 8 | 349 |

We claim:

1. A process comprising:

(a) extracting organonitrogen impurities from a fuel stream containing organonitrogen and organosulfur impurities whereby the nitrogen content of fuel stream is reduced by at least 50 percent to produce a fuel stream having a reduced amount of organonitrogen impurities;

(b) separating and recovering the fuel stream having a reduced amount of organonitrogen impurities; and (c) contacting the separated fuel stream having a reduced amount of organonitrogen impurities with an organic hydroperoxide in the presence of a titanium-containing silicon oxide catalyst wherein a substantial portion of the organosulfur impurities are converted into sulfones.

2. The process of claim 1 wherein the organonitrogen impurities are extracted by solid-liquid extraction using at least one adsorbent.

3. The process of claim 2 wherein the adsorbent is selected from the group consisting of aluminum oxide, silicon oxide, silica-alumina, Y zeolite, Zeolite X, ZSM-5, and sulfonic acid resin.

4. The process of claim 3 wherein the adsorbent is selected from the group consisting of aluminum oxide, silica-alumina, and Y zeolite.

5. The process of claim 1 wherein the organonitrogen impurities are extracted by liquid-liquid extraction using at least one polar solvent.

6. The process of claim 5 wherein the polar solvent is selected from the group consisting of alcohol, ketone, water, and mixtures thereof.

7. The process of claim 6 wherein the ketone is a $C_3$-$C_8$ aliphatic ketone.

8. The process of claim 7 wherein the ketone is acetone.

9. The process of claim 6 wherein the alcohol is a $C_1$-$C_4$ alcohol.

10. The process of claim 9 wherein the alcohol is methanol.

11. The process of claim 5 wherein the polar solvent is a mixture of methanol and water.

12. The process of claim 1 wherein the organic hydroperoxide is t-butyl hydroperoxide.

13. The process of claim 1 wherein the titanium-containing silicon oxide catalyst is titania-on-silica.

14. The process of claim 1 comprising an additional step after step (c) of removing the sulfones from the fuel stream by solid-liquid or liquid-liquid extraction.

15. A process comprising:

(a) extracting organonitrogen impurities from a diesel fuel stream containing organonitrogen and organosulfur impurities whereby the nitrogen content of fuel stream is reduced by at least 50 percent to produce a fuel stream having a reduced amount of organonitrogen impurities;

(b) separating and recovering the diesel fuel stream having a reduced amount of organonitrogen impurities; and (c) contacting the separated diesel fuel stream having a reduced amount of organonitrogen impurities with t-butyl hydroperoxide in the presence of a titania-on-silica catalyst wherein a substantial portion of the organosulfur impurities are converted into sulfones.

16. The process of claim 15 wherein the organonitrogen impurities are extracted by solid-liquid extraction using at least one adsorbent selected from the group consisting of aluminum oxide, silica-alumina and Y zeolite.

17. The process of claim 15 wherein the organonitrogen impurities are extracted by liquid-liquid extraction using at least one polar solvent selected from the group consisting of $C_1$-$C_4$ alcohol, $C_3$-$C_8$ aliphatic ketone, water, and mixtures thereof.

18. The process of claim 17 wherein the ketone is acetone.

19. The process of claim 17 wherein the alcohol is methanol.

20. The process of claim 17 wherein the polar solvent is a mixture of methanol and water.

21. The process of claim 15 comprising an additional step after step (c) of removing the sulfones from the diesel fuel stream by solid-liquid or liquid-liquid extraction.

* * * * *